US005307540A

United States Patent [19]

Genevray

[11] Patent Number: 5,307,540

[45] Date of Patent: May 3, 1994

[54] WOOL CARD

[75] Inventor: Henri Genevray, Guebwiller, France

[73] Assignee: N. Schlumberger Et Cie, S.A., Guebwiller, France

[21] Appl. No.: 894,946

[22] Filed: Jun. 8, 1992

[30] Foreign Application Priority Data

Jun. 7, 1991 [FR] France ..... 91 07110

[51] Int. Cl.[5] ..... D01B 1/00

[52] U.S. Cl. ..... 19/84; 19/99

[58] Field of Search ..... 19/98, 99, 85, 87, 93, 19/100, 101, 84, 112, 113, 114, 104

[56] References Cited

U.S. PATENT DOCUMENTS

| | | | |
|---|---|---|---|
| 318,121 | 5/1885 | Klein | 19/84 |
| 1,567,841 | 12/1925 | Curtin | 19/100 |
| 2,009,282 | 7/1935 | Thibeau | 19/84 |
| 2,115,605 | 4/1938 | Allen et al. | 19/84 |
| 2,189,519 | 2/1940 | Harrison et al. | 19/84 |
| 2,478,799 | 8/1949 | Wilkinson | 19/98 |
| 5,142,741 | 9/1992 | Demoth et al. | 19/113 |

FOREIGN PATENT DOCUMENTS

| | | |
|---|---|---|
| 150650 | 9/1902 | Fed. Rep. of Germany . |
| 2232626 | 1/1975 | France . |
| WO91/09164 | 6/1991 | World Int. Prop. O. . |

*Primary Examiner*—Clifford D. Crowder
*Assistant Examiner*—Michael A. Neas
*Attorney, Agent, or Firm*—Young & Thompson

[57] ABSTRACT

A wool card includes a rotatable Morel roller and first and second burr beaters rotatable relative to the Morel roller and relative to each other and spaced apart about the periphery of the Morel roller. The wool to be carded moves in one direction about the Morel roller and between the first burr beater and the Morel roller and then between the second burr beater and the Morel roller. The first burr beater turns at a lower speed than the second burr beater. The burr beaters have blades thereon which contact the wool to remove impurities from the wool. The number of blades on the first burr beater is less than the number of blades on the second burr beater.

1 Claim, 1 Drawing Sheet

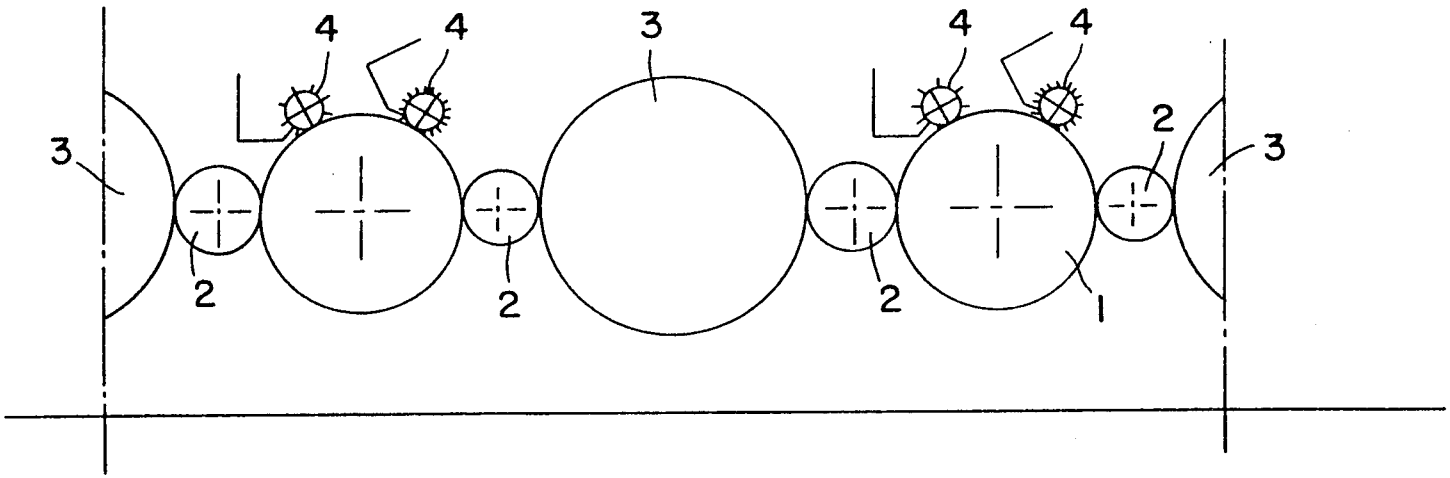
4
4
3
2
1
2
3
2
4
4
2
3

WOOL CARD

The present invention concerns the field of the textile industry, and, more particularly, has for its object the wool cards working wool and long fibers.

At present, the existing cards of this type are generally double cards with an intermediate comb displaying a substantial reduction in speed and a high purification capability.

Such a configuration has the drawback of provoking the shortening of the fibers, which is very prejudicial to the finished product, because, in a general manner, to obtain a thread of optimal quality, one must strive to obtain and to keep fibers of a maximum length.

In these existing cards, use is generally made of two Morel rollers mounted in tandem or in another manner.

To obtain the worsted effect, the speed of the fiber web to treat is reduced before each Morel roller, between the feeder roller and the large drum, in such a manner that the orientation of the impurities contained in the fiber web are modified so that the burr beater of the corresponding Morel roller eliminates them.

However, using this reduced number of Morel rollers has the drawback, on the one hand, of allowing the obtainment of a relatively unclean product only and, on the other hand, because of this reduced number of rollers, the necessary reduction in speed at the level of each Morel roller is very substantial and leads to a breakage of the fibers, which is considerably injurious to the quality of the obtained product.

A substantial reduction of speed at the level of each Morel roller is more particularly necessary because a maximum quantity of impurities, such as burrs, straws or other vegetable fibers, must be torn from the accumulated web on each Morel roller upon its passage under the corresponding burr beater.

In addition, because of the substantial reduction in speed at the level of each Morel roller, the fiber web emerges at a relatively low speed, which leads to a relatively low yield.

In addition, each Morel roller being equipped with only one burr beater, the removal of the burrs is limited and, in the presence of supply material of high impurity content, the end product affords an imperfect cleanliness.

Finally, the placement of Morel rollers in tandem, destined to allow the obtainment of a final product of better quality, leads to a much more substantial size of the card and a consequential diminution of the working speed of the latter due to the increase in the number of transfers between the rollers, from which a relatively low output results.

The goal of the present invention is to extenuate these drawbacks.

The invention thus has for its object a wool card, comprising at least two Morel rollers, characterized in that each Morel roller is equipped with at least two burr beaters, the reduction in speed of the fiber web between the large drum and the following Morel roller being relatively small.

The invention will be better understood thanks to the following description, which concerns a preferred embodiment, given as a non-limiting example and explained with reference to the attached schematic drawings, whose sole figure is a lateral elevational view of a card conforming to the invention.

The attached drawing represents a section of a wool card, on which a Morel roller 1 is mounted, with the interposition of communicating rollers 2, between two large drums 3. In such a card, the fiber web brought by the upstream large drum 3 is deflected with the aid of the first communicating roller 2 onto the Morel roller 1 for its burr removal treatment, another burr removal treatment being effectuated on at least a second Morel roller, not represented.

In accordance with the invention, each Morel roller 1 is provided with at least two burr beaters 4 and the reduction in speed of the fiber web between the large drum 3 and the following Morel roller 1 is relatively small. This embodiment allows, at the least, the doubling of the cleaning operations on each Morel roller 1 and so, to considerably increase the removal of the vegetable impurities.

According to another characteristic of the invention, the first burr beater 4 of each Morel roller 1, seen in the direction of progression of the fiber web to be treated, has advantageously a limited number of blades, turns at a relatively low speed and removes the gross impurities by tearing them out, the following burr beater or burr beaters 4 having a greater number of blades, turning at a greater speed and eliminating the finer impurities, essentially by a suction effect, the adjustment of the first burr beaters 4 and of the other burr beaters 4 being independently effectuated to different distances from the corresponding Morel rollers 1. In this manner, it is possible to optimally effectuate the burr removal process as to all vegetable matters of different coarseness.

According to another characteristic of the invention, the Morel rollers 1, equipped with several burr beaters 4, are placed in different locations in the card and are either coupled to each other, or separately driven.

Grouping several burr beaters 4 on a common Morel roller 1 makes for a much less cumbersome whole than placing two Morel rollers in tandem. In addition, it is possible to realize a more compact card construction with greater effectiveness of the burr beaters 4.

The increase in the number of burr beaters 4 in a card allows the number of transfer points to be reduced and, in that manner, allows an increase in the peripheral speed of the Morel rollers 1 and thus allows an increase in the speed ranges of these latter and of the burr beaters 4.

Thanks to the invention, it is possible to realize a card having a high cleaning capability while preserving the fibers from breakage, these latter being, because of this fact, of better quality. The end result is that the obtained product is a better refined product.

In addition, the provision of a large number of burr beaters 4 allows a substantial distribution of the extraction of the burrs and other impurities, and thus to limit the reduction of the tangential velocity of the fiber web with an accumulation over a lesser thickness, so that the treatment speed of the web is increased, which leads to a corresponding increase in the output of the machine.

It is to be understood that the invention is not limited to the embodiment described and represented in the attached drawings. Modifications remain possible, notably in the constitution of the various elements, or by substituting technical equivalents without thereby departing from the scope of protection of the invention.

What is claimed is:

1. Wool card for treating a fiber web, comprised of at least two Morel rollers (1), each Morel roller (1) having at least two burr beaters (4), there being a relatively low reduction in speed of the fiber web between a large drum (3) and the following Morel roller (1), the first burr beater (4) of each Morel roller (1), seen in the direction of progression of the fiber web to be treated, has a limited number of blades, turns at a relatively slow speed and removes the gross impurities by tearing them out, the following burr beater or burr beaters (4) having a greater number of blades, turning at a greater speed and eliminating the finer impurities, essentially by a suction effect.

* * * * *